US006855032B1

(12) United States Patent
Yang et al.

(10) Patent No.: US 6,855,032 B1
(45) Date of Patent: Feb. 15, 2005

(54) FINE FORCE CONTROL OF ACTUATORS FOR CHEMICAL MECHANICAL POLISHING APPARATUSES

(75) Inventors: Pai-Hsueh Yang, Palo Alto, CA (US); Bausan Yuan, San Jose, CA (US)

(73) Assignee: Nikon Corporation (JP)

( * ) Notice: Subject to any disclaimer, the term of this patent is extended or adjusted under 35 U.S.C. 154(b) by 0 days.

(21) Appl. No.: 10/722,090

(22) Filed: Nov. 24, 2003

(51) Int. Cl.[7] ..... B24B 49/00
(52) U.S. Cl. ..... 451/5; 451/11; 451/288
(58) Field of Search ..... 451/5, 41, 57, 451/59, 285, 286, 287, 288, 9, 10, 11

(56) References Cited

U.S. PATENT DOCUMENTS 4,811,522 A 3/1989 Gill, Jr.
5,882,243 A * 3/1999 Das et al. ..... 451/5
5,989,103 A * 11/1999 Birang et al. ..... 451/41
5,989,104 A * 11/1999 Kim et al. ..... 451/41
6,059,638 A * 5/2000 Crevasse et al. ..... 451/41
6,213,855 B1 * 4/2001 Natalicio ..... 451/364
2002/0033230 A1 3/2002 Hayashi et al.

* cited by examiner

*Primary Examiner*—Dung Van Nguyen
(74) *Attorney, Agent, or Firm*—Steven G. Roeder; Jim Rose

(57) ABSTRACT

An actuator assembly (432) for positioning a pad (48) includes a first actuator assembly (440), a second actuator subassembly (442) and a control system (524). In one embodiment, the first actuator subassembly (440) includes a first core (502), and a conductor (504) secured to the first core (502), and the second actuator subassembly (442) includes a second core (506) spaced apart a component gap (444) from the first core (502). Further, the control system (524) directs current to the conductor (504) to attract the second core (506) to the first core (502). In one embodiment, the amount of current directed to the conductor (504) is calculated without measuring the component gap (444).

31 Claims, 12 Drawing Sheets

FINE FORCE CONTROL OF ACTUATORS FOR CHEMICAL MECHANICAL POLISHING APPARATUSES

FIELD OF THE INVENTION

The present invention relates to a method for maintaining fine force control between a polishing pad and a wafer that is being polished by the pad. The present invention also relates to an apparatus that utilizes actuators to perform fine force control without the need of gap measurement.

BACKGROUND

Chemical mechanical polishing apparatuses (CMP apparatuses) are commonly used for the planarization of silicon wafers. In one type of CMP apparatus, a rotating pad is placed in contact with a rotating wafer and the pad is moved back and forth laterally relative to the rotating wafer. Additionally, a polishing slurry is forced into a gap between the wafer and the pad. The slurry is typically an aqueous solution that carries a high concentration of nanoscale abrasive particles. The slurry can play a number of critical roles in the polishing of the wafer. For example, the chemical composition of the slurry can after the surface properties of the wafer, soften the wafer surface and make it amenable to material removal. Further, the abrasive particles in the slurry remove material from the wafer surface by cutting nanoscale grooves in the wafer surface.

Some in the industry believe that most of the material removal occurs when pad asperities on the pad are in contact with the wafer, trapping slurry particles between them. The asperities push the particles into the wafer surface and drag them along so the abrasive particles act as nanoscale cutting tools.

Designers are constantly trying to improve the accuracy and efficiency of CMP apparatuses. For example, if the force applied by the pad against the wafer is not uniform, the material removal rate will not be uniform. Additionally, if the force applied by the pad against the wafer is not precisely controlled, the planarity of the wafer and accuracy of the CMP apparatus will be diminished.

SUMMARY

The present invention is directed to an actuator assembly including a first attraction only actuator and a control system. In one embodiment, the first actuator includes a first core, a conductor secured to the first core, and a second core spaced apart a component gap from the first core. Further, the control system directs current to the conductor to attract the second core to the first core. In one embodiment, the amount of current directed to the conductor is calculated without measuring the component gap.

In one embodiment, the control system utilizes the simplified formula of $I=\sqrt{F}$ to calculate the amount of current directed to the conductor. In this embodiment, I is the current and F is the force generated by the first actuator.

In another embodiment, the control system calculates the component gap from at least one previous sample. The calculated component gap is used for calculating the amount of current directed to the conductor at a subsequent time. In another embodiment, the control system uses calculated component gap information from a plurality of previous samples to determine the amount of current to direct to the conductor at a subsequent time.

The present is also directed to a system and method for accurately controlling the force applied by a pad against a wafer. In some embodiments, the present invention provides a system and method for controlling actuators without directly measuring the component gap between components of the actuators and an actuator assembly that can be controlled without measuring the component gap.

The present invention is also directed to a CMP apparatus, a method for controlling an actuator assembly, and a method for making a CMP apparatus. Additionally, the present invention is directed to an object or wafer that has been polished by the methods or apparatuses provided herein.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1:
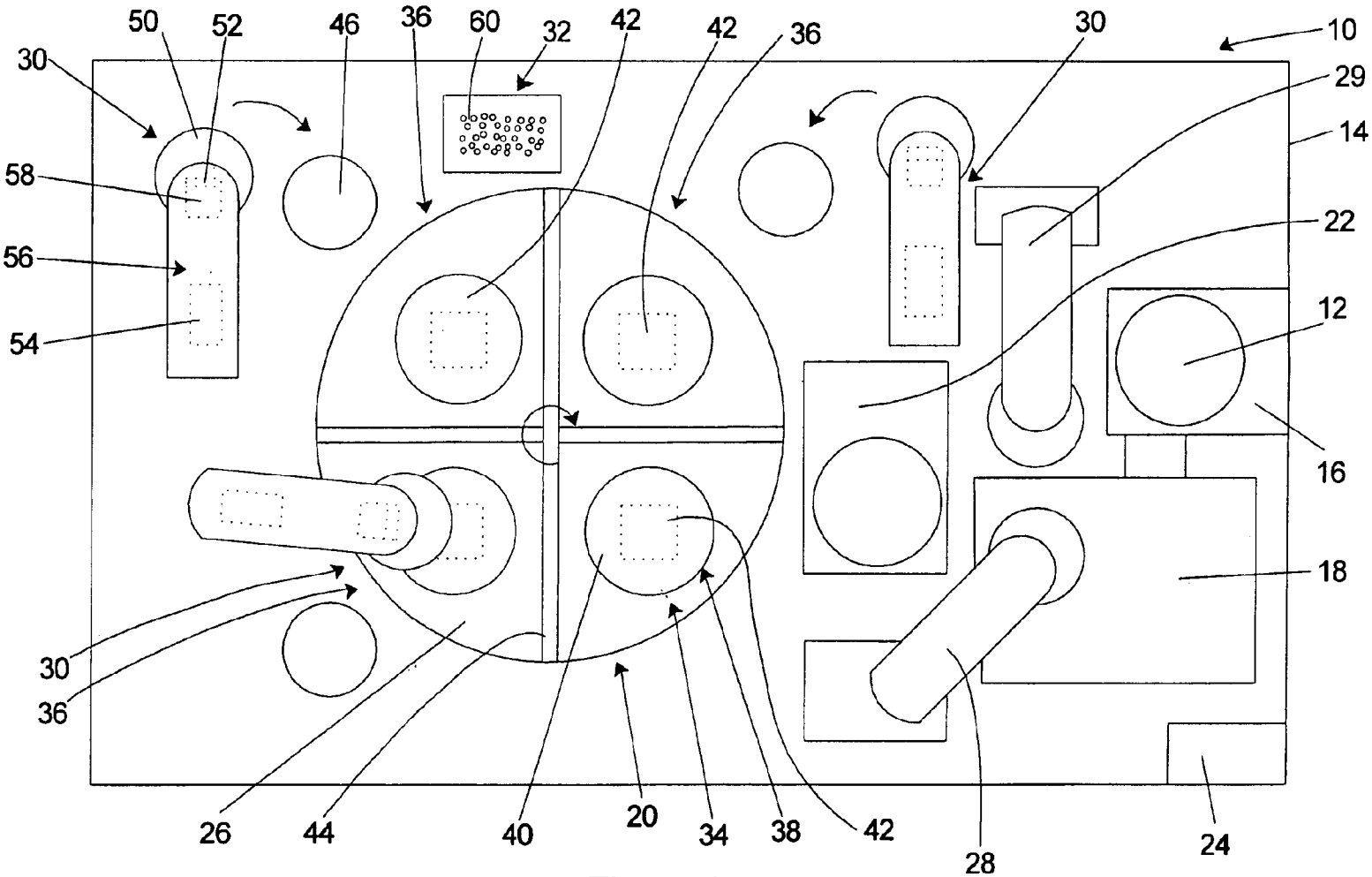
FIG. 1 is a schematic illustration of an apparatus having features of the present invention.

FIG. 1 illustrates a top plan illustration of a precision apparatus 10 having features of the present invention. For example, the apparatus 10 can be used for the preparation, cleaning, polishing, and/or planarization of a substrate 12. The design of the apparatus 10 and the type of substrate 12 can vary. In the embodiment illustrated in FIG. 1, the apparatus 10 is a Chemical Mechanical Polishing system that is used for the planarization of a semiconductor wafer 12. Alternatively, for example, the apparatus 10 can be used to clean and/or polish another type of substrate 12, such as bare silicon, glasses, a mirror, or a lens.

In FIG. 1, the apparatus 10 includes a frame 14, a loading station 16, a cleaning station 18, a polishing station 20, a receiving station 22, and a control system 24. The frame 14 supports the other components of the apparatus 10.

The loading station 16 provides a holding area for storing a number of substrates 12 that have not yet been prepared for their intended purpose. For example, the substrates 12 can be unplanarized and unpolished. The substrates 12 are transferred from the loading station 16 to the receiving station 22. The substrate 12 is then transferred to the polishing station 20 where the substrate 12 is planarized and polished to meet the desired specifications. After the substrate 12 has been planarized and polished, the substrate 12 is then transferred through the receiving station 22 to the cleaning station 18. The cleaning station 18 can include a rotating brush (not shown) that gently cleans a surface of the substrate 12. After the cleaning procedure, the substrate 12 is transferred to the loading station 16 from where it can be removed from the apparatus 10 and further processed.

In the embodiment illustrated in FIG. 1, the polishing station 20 includes a polishing base 26, two transfer devices 28, 29, three polishing systems 30, and a fluid source 32. Alternatively, for example, the polishing station 20 can be designed with more than three polishing systems 30 or less than three polishing systems 30 or more than one fluid source 32.

The polishing base 26 is substantially disk shaped and is designed to be rotated in either a clockwise or counterclockwise direction about a centrally located axis. As shown in FIG. 1, the polishing base 26 can be designed to rotate in a clockwise direction about the axis to progressively and stepwise move the substrate 12 from a load/unload area 34 to each of three polishing areas 36 and then back to the load/unload area 34. The polishing base 26 can also referred to as an index table.

In FIG. 1, the polishing base 26 includes four holder assemblies 38 that each retain and rotate one substrate 12. Each holder assembly 38 includes a vacuum chuck or gimbaled substrate holder 40 that retains one substrate 12 and a substrate rotator 42 (illustrated in phantom) that rotates the substrate holder 40 and the substrate 12 about a substrate axis of rotation during polishing. Additionally, the polishing base 26 includes a "+" shaped divider that separates the substrate holders 40.

The substrate rotator 42 can be designed to rotate the substrate 12 in the clockwise direction or the counter clockwise direction. In one embodiment, the substrate rotator 42 includes a motor that selectively rotates the substrate 12 between approximately negative 400 and 400 revolutions per minute.

In FIG. 1, each holder assembly 38 holds and rotates one substrate 12 with the surface to be polished facing upward. Alternatively, for example, the polishing station 20 could be designed to hold the substrate 12 with the surface to be polished facing downward or to hold the substrate 12 without rotating the substrate 12 during polishing.

The transfer device 29 transfers the substrate 12 to be polished from the receiving station 22 to the substrate holder 40 positioned in the load/unload area 34. Subsequently, the transfer device 28 transfers a polished substrate 12 from the substrate holder 40 positioned in the load/unload area 34 through the receiving station 22 to the cleaning station 18. The transfer devices 28 and 29 can include a robotic arm that is controlled by the control system 24.

The polishing station 20 illustrated in FIG. 1 includes three polishing systems 30, each of the polishing systems 30 being designed to polish the substrate 12 to a different set of specifications and tolerances. By using three separate polishing systems 30, the apparatus 10 is able to deliver improved planarity and step height reduction, as well as total throughput. The desired polished profile can also be changed and controlled depending upon the requirements of the apparatus 10.

The design of each polishing system 30 can be varied. In FIG. 1, each polishing system 30 includes a pad conditioner 46; a polishing pad 48 (illustrated in FIG. 3A) having a polishing surface; a pad holder 50; a pad rotator 52 (illustrated in phantom); a lateral mover 54 (illustrated in phantom); a polishing arm 56 that moves the polishing pad 48 between the pad conditioner 46 and a location above the substrate 12 on the polishing base 26; a pad vertical mover assembly 58 (illustrated in phantom in FIG. 1); and a detector (not shown) that monitors the surface flatness of the substrate 12. In this embodiment, each polishing system 30 holds the polishing pad 48 so that the polishing surface faces downward. However, the apparatus 10 could be designed so that the polishing surface of one or more of the polishing pads 48 is facing upward.

The pad conditioner 46 conditions and/or roughens the polishing surface of the polishing pad 48 so that the polishing surface has a plurality of asperities and to ensure that the polishing surface of the polishing pad 48 is uniform.

The pad rotator 52 rotates the polishing pad 48. The rotation rate can vary. In one embodiment, the pad rotator 52 includes a rotator motor (not shown) that selectively rotates the polishing pad 48 at between approximately negative 800 and 800 revolutions per minute.

In one embodiment, the difference in relative rotational movement of the pad rotator 52 and the substrate rotator 42 is designed to be relatively high, approximately between negative 800 and 400 revolutions per minute. In this embodiment, the high speed relative rotation, in combination with relatively low pressure between the polishing pad 48 and the substrate 12 helps to enable greater precision in planarizing and polishing the substrate 12. Further, the polishing pad 48 and the substrate 12 can be rotated in the same or opposite direction.

The pad lateral mover 54 selectively moves and sweeps the pad 48 back and forth laterally, in an oscillating motion relative to the substrate 12. This allows for uniform polishing across the entire surface of the substrate 12. In one embodiment, the pad lateral mover 54 moves the polishing pad 48 laterally a distance of between approximately 30 mm and 80 mm and at a rate of between approximately 1 mm/sec and 200 mm/sec. However, other rates are possible.

The pad vertical mover assembly 58 moves the polishing pad 48 vertically and at least partly controls the force that the polishing pad 48 applies against the substrate 12. In one embodiment, the pad vertical mover assembly 58 applies between approximately 0 and 10 psi between the polishing pad 48 and the substrate 12. The pad vertical mover assembly 58 further provides forces to help maintain the force between the polishing pad 48 and the substrate 12 at a substantially equal level across the cross-section of the polishing pad 48. In one embodiment, the pad vertical mover assembly 58 maintains the force at a substantially equal level across the cross-section of the polishing pad 48 above the substrate 12 regardless of whether the polishing pad 48 is positioned entirely above the surface of the substrate 12 or whether the polishing pad 48 extends beyond the outer edge of the substrate 12. The pad vertical mover assembly 58 is described in greater detail below.

The fluid source 32 provides a pressurized polishing fluid 60 (illustrated as circles) into a gap 64 (illustrated in FIG. 3A) between the polishing pad 48 (illustrated in FIG. 3A) and the substrate 12. The type of fluid 60 utilized can be varied according to the type of substrate 12 that is polished. In one embodiment, the fluid 60 is a slurry that includes a plurality of nanoscale abrasive particles dispersed in a liquid. For example, the slurry used for chemical mechanical polishing can include abrasive particles comprised of metal oxides such as silica, alumina, titanium oxide and cerium oxide of a particle size of between about 10 and 200 nm in an aqueous solution. Slurries for polishing metals typically require oxidizers and an aqueous solution with a low pH (0.5 to 4.0). However, when planarizing an oxide layer, an alkali based solution (KOH or NH4OH) with a pH of 10 to 11 can be used.

In another embodiment, the slurry can include non-abrasive particles and/or abrasive-free particles.

In one embodiment, the chemical solution in the slurry can create a chemical reaction at the surface of the substrate 12 which makes the surface of the substrate 12 susceptible to mechanical abrasion by the particles suspended in the slurry. For example, when polishing metals, the slurry may include an oxidizer to oxidize the metal because metal oxides polish faster compared to the pure metal. Additionally, the fluid 60 can also include a suspension agent that is made up of mostly water plus fats, oils or alcohols that serve to keep the abrasive particles in suspension throughout the slurry.

The rate of fluid flow and the pressure of the fluid 60 directed into the gap 64 can also vary. In one embodiment, the fluid 60 is directed into the gap 64 at a flow rate of between approximately 50 ml/sec and 300 ml/sec and at a pressure of between approximately 0 and 10 psi.

The control system 24 controls the operation of the components of the apparatus 10 to accurately and quickly polish the substrates 12. For example, the control system 24 can control (i) each substrate rotator 42 to control the rotation rate of each substrate 12, (ii) each pad rotator 52 to control the rotation rate of each polishing pad 48, (iii) each pad lateral mover 54 to control the lateral movement of each polishing pad 48, (iv) each pad vertical mover assembly 58 to control the force applied by each polishing pad 48, and (v) the fluid source 32 to control the fluid flow in the gap 64.

The control system 24 can include one or more conventional CPU's and data storage systems. In one embodiment, the control system 24 is capable of high volume data processing.

Figure 2:
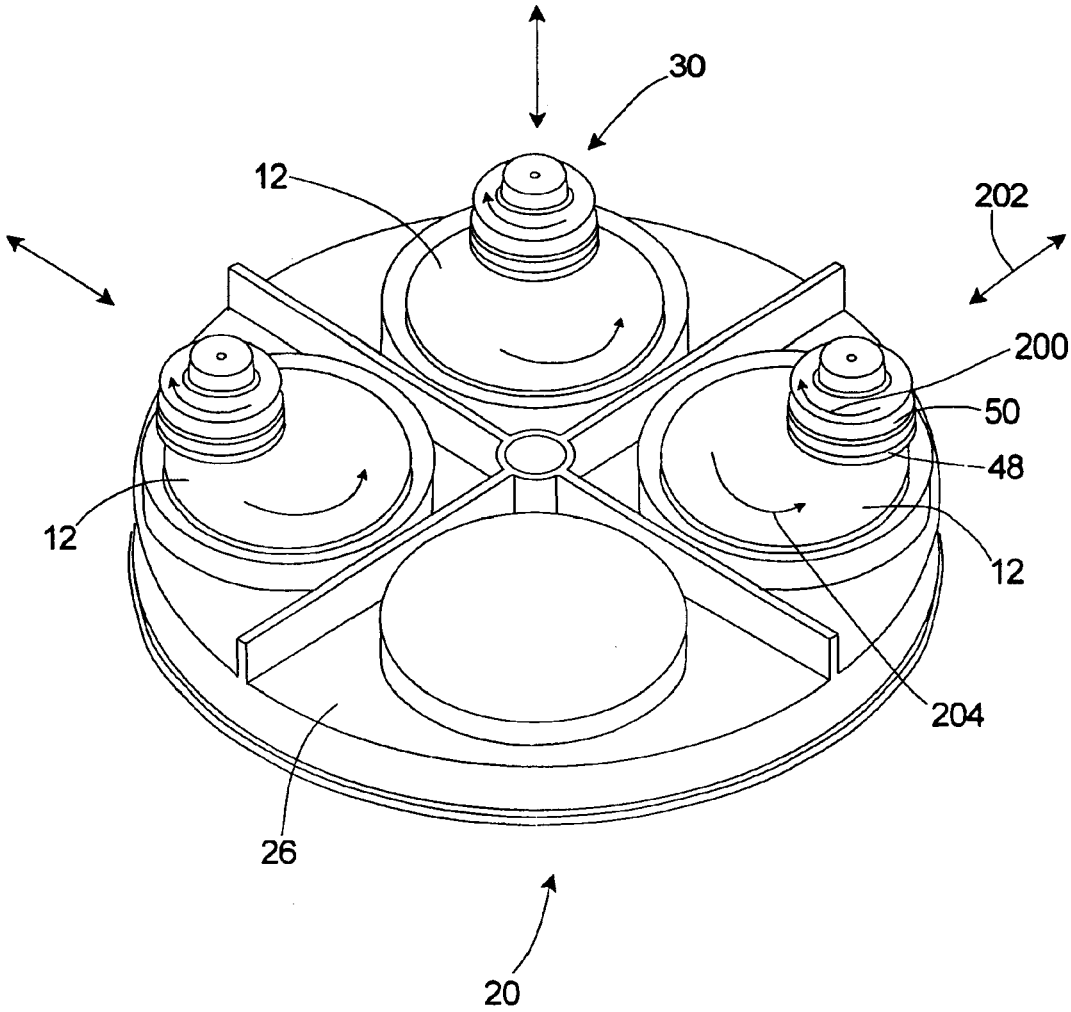
FIG. 2 is a perspective view of a portion of a polishing station of the apparatus of FIG. 1.

FIG. 2 illustrates a perspective view of a portion of the polishing station 20 of FIG. 1 and three substrates 12. More specifically, FIG. 2 illustrates the polishing base 26 and a portion of three polishing systems 30. In this embodiment, each of the pad holders 50 and polishing pads 48 are rotated as indicated by arrows 200 and moved laterally relative to the surface of the substrate 12 as indicated by arrows 202 and each substrate 12 is rotated as indicated by arrows 204.

Figure 3A:
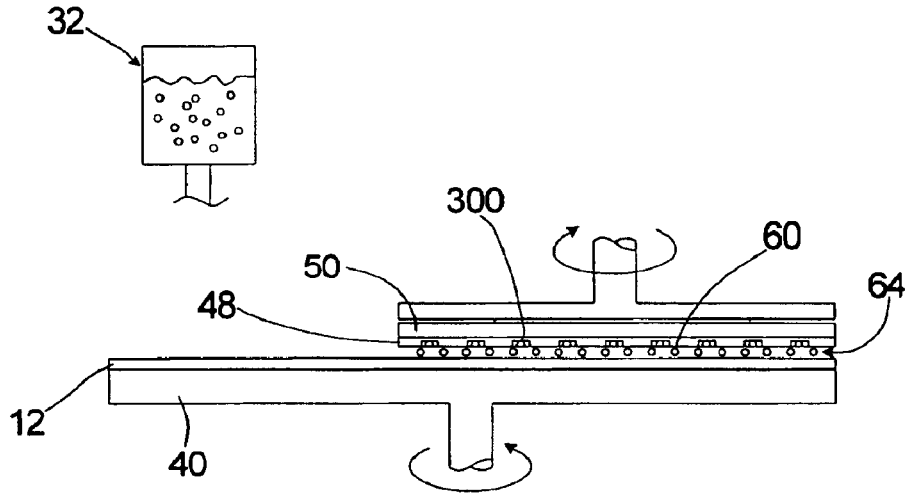
FIG. 3A is a side illustration of a substrate holder, a substrate, a pad holder, a pad, and a fluid supply having features of the present invention with the pad in a first lateral position relative to the substrate.

FIG. 3A is a side illustration of the substrate holder 40, the substrate 12, the pad holder 50, the pad 48, and the fluid source 32 with the pad 48 in a first lateral position relative to the substrate 12. FIG. 3A also illustrates the gap 64 (which is greatly exaggerated) and the fluid 60 (which is greatly exaggerated) in the gap 64. In the first lateral position, the pad 48 is completely positioned over the substrate 12.

In this embodiment, the polishing pad 48 is relatively small in diameter compared to the substrate 12. This can facilitate high speed rotation of the polishing pad 48. Additionally, the relatively small size of the polishing pad 48 results in a polishing pad 48 that is lightweight, with less pad deformity, which in turn allows for improved planarity. Alternatively, for example, the polishing pad 48 can have an outer diameter that is greater than the outer diameter of the substrate 12.

The fluid 60 supplied under pressure into the gap 64 by the fluid source 32 generates hydrostatic lift under the polishing pad 48 that reduces the load applied to the asperities of the polishing surface of the polishing pad 48.

In one embodiment, the polishing pad 48 is made of a relatively soft and wetted material such as blown polyurethane or similar substance. For example, the polishing pad 48 can be made of felt impregnated with polyurethane. The polishing surface of the polishing pad 48 is roughened to create a plurality of asperities on the polishing surface of the polishing pad 48.

In one embodiment, the polishing pad 48 is flat, annular shaped and has an outer diameter of between approximately 260 mm and 150 mm and an inner diameter of between approximately 80 mm and 40 mm. Polishing pads 48 within this range can be used to polish a wafer having a diameter of approximately 300 mm or 200 mm. Alternatively, the polishing pad 48 can be larger or smaller than the ranges provided above.

Additionally, in one embodiment, the polishing surface of the polishing pad 48 includes a plurality of grooves 300 positioned in a rectangular shaped grid pattern. Each of the grooves 300 has a groove depth and a groove width. The grooves 300 cooperate to form a plurality of spaced apart plateaus on the polishing surface of the polishing pad 48. The grooves 300 reduce pressure and hydrostatic lift in the gap 64. It should be noted that the groove shape and pattern can be changed to alter the polishing characteristics of the polishing pad 48. For example, each groove 300 can be a depth and a width on the order of between approximately 0.1 mm and 1.5 mm. Also, the grooves 300 may be in a different pattern and shape. For example, a set of radial grooves combined with a set of circular grooves also could be utilized.

Alternatively, a polishing pad 48 without grooves can be used in one or more of the polishing systems 30. Still alternatively, the polishing pad 48 could be another type of substrate.

Figure 3B:
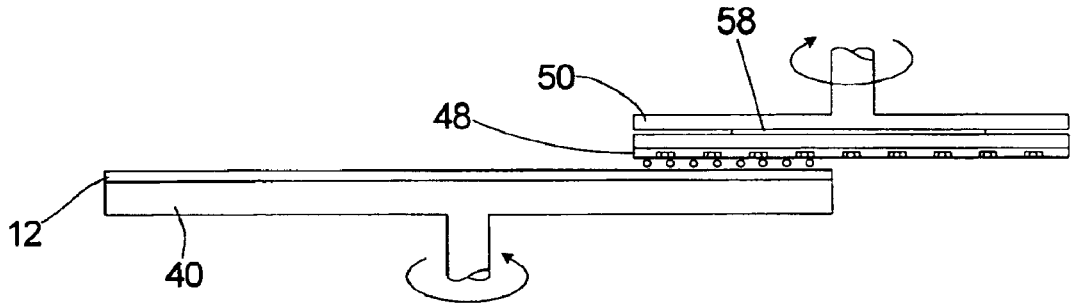
FIG. 3B is a side illustration of a substrate holder, a substrate, a pad holder, a pad, and a fluid supply with the pad in a second lateral position relative to the substrate.

FIG. 3B is a side illustration of the substrate holder 40, the substrate 12, the pad holder 50, and the pad 48, with the pad 48 in a second lateral position relative to the substrate 12. In the second lateral position, the pad 48 is only partly positioned over the substrate 12.

As an overview, in one embodiment, the control system 24 (illustrated in FIG. 1) controls the pad vertical mover assembly 58 to maintain the force at a substantially equal and uniform level across the cross-section of the polishing pad 48 above the substrate 12 regardless of whether the polishing pad 48 is positioned entirely above the surface of the substrate 12 or whether the polishing pad 48 extends beyond the outer edge of the substrate 12. The pad vertical mover assembly 58 is described in greater detail below.

Figure 4A:
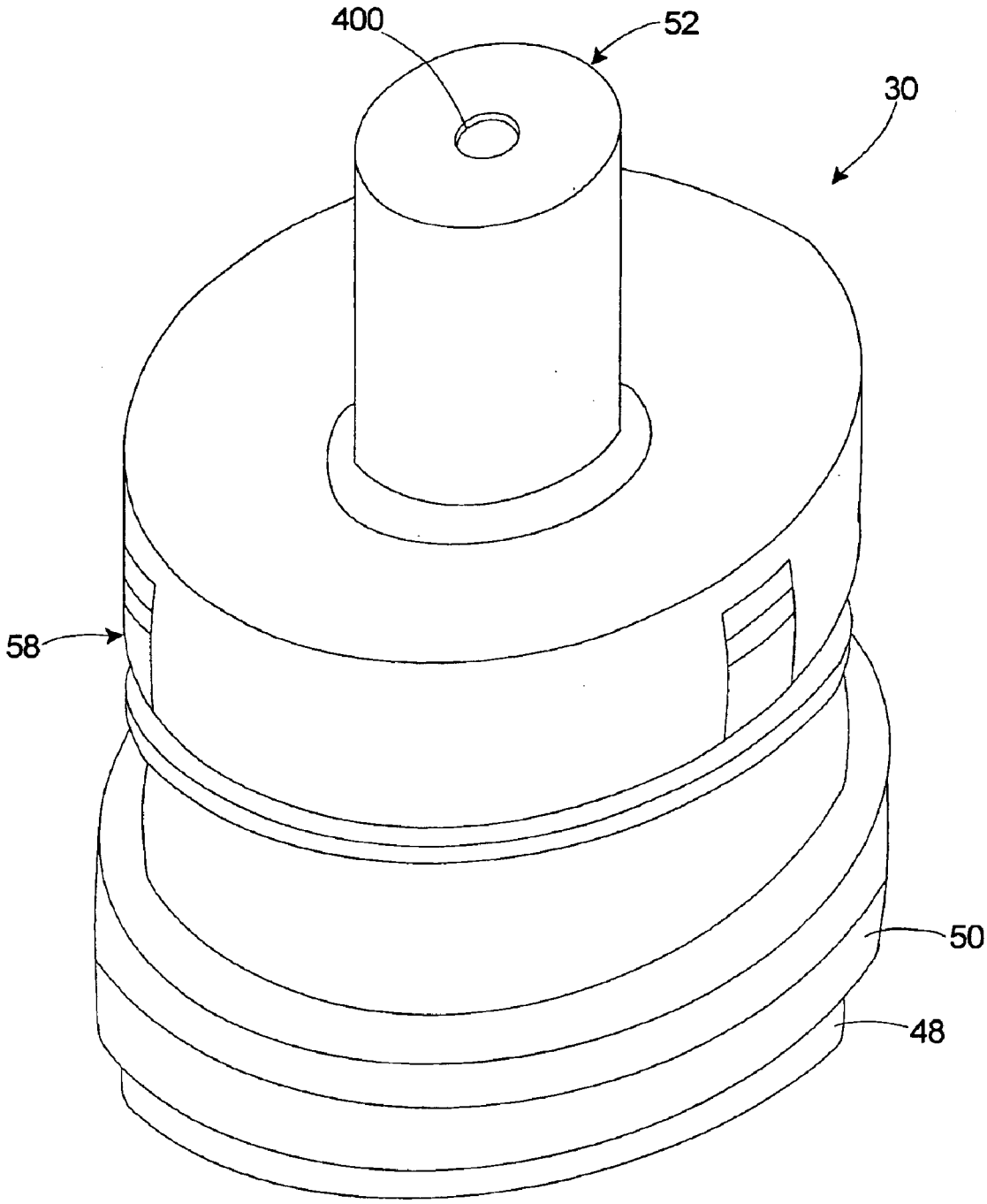
FIG. 4A is a perspective view of a polishing head assembly having features of the present invention.

FIG. 4A is a perspective view a polishing system 30 including the pad holder 50, the polishing pad 48, a portion of the pad rotator 52, a fluid conduit 400, and the vertical mover assembly 58 that can be used in the apparatus 10 of FIG. 1. The design of each of these components can be varied to suit the design requirements of the apparatus.

Figure 4B:
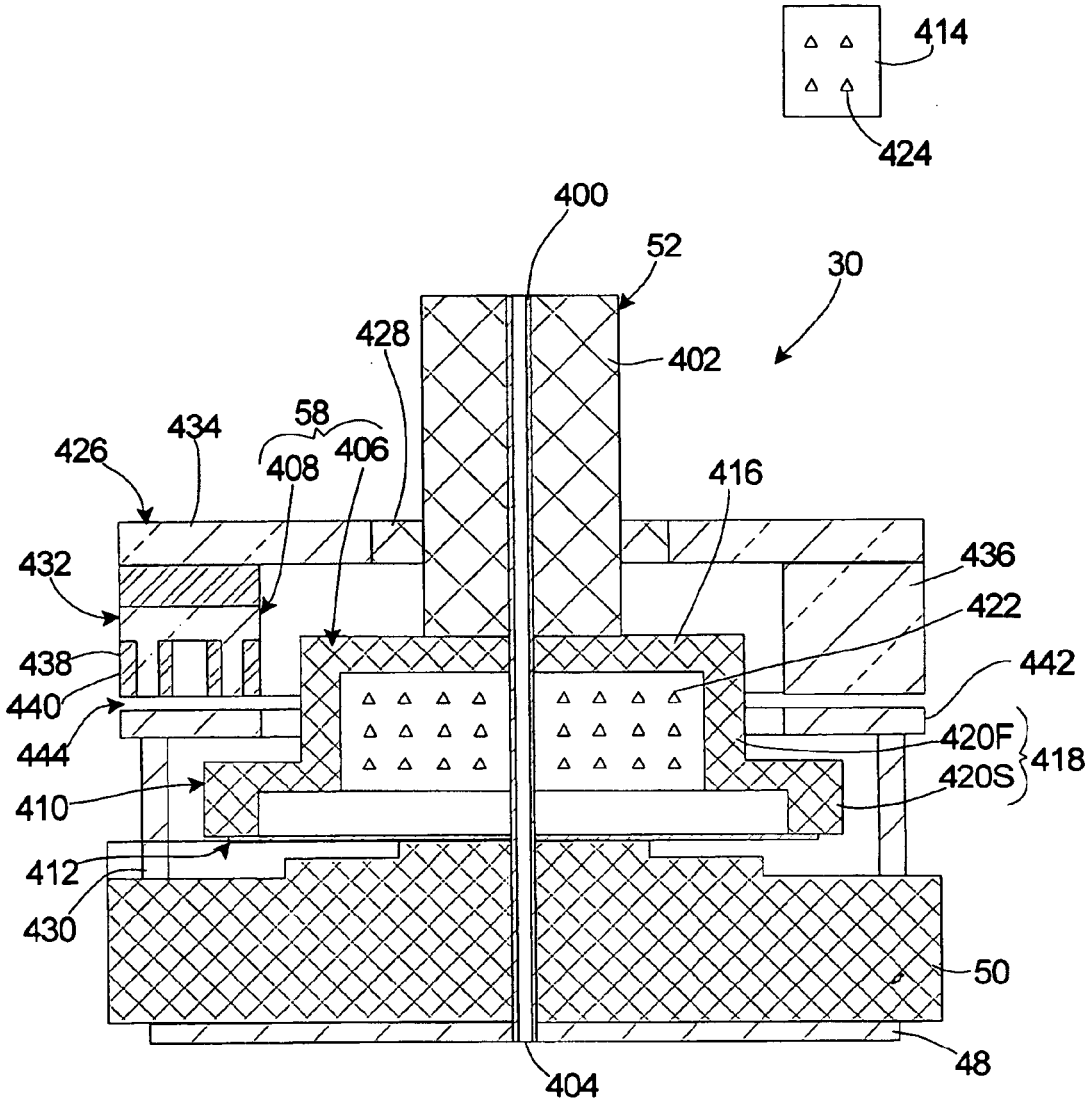
FIG. 4B is a cut-away view of the polishing head assembly of FIG. 4A.

FIG. 4B is a cut-away view of the polishing system 30 of FIG. 4A. In this embodiment, the pad holder 50 is generally disk shaped and retains the polishing pad 48. In one embodiment, the pad holder 50 uses vacuum pressure to hold the polishing pad against the pad holder. The pad holder 50 is also referred to herein as a stage.

The pad rotator 52 includes a rotator shaft 402 that is coupled to and rotated about a central axis by the rotator motor (not shown). In FIG. 4B, the rotator shaft 402 has a substantially circular cross-section and is coupled to the pad holder 50 so that rotation of the rotator shaft 402 results in rotation of the pad holder 50.

The fluid conduit 400 is used to transfer fluid between the fluid source 32 (illustrated in FIG. 1) and the gap 64 (illustrated in FIG. 3A). In FIG. 4B, the fluid conduit 400 is a tube that extends through rotator shaft 402, the vertical mover assembly 58, and the pad holder 50. In one embodiment, the fluid conduit 400 allows for relative motion between the pad holder 50 and the rotator shaft 402. In FIG. 4B, the fluid conduit 400 includes a fluid outlet 404 positioned near the polishing pad 48. However, the number and location of the fluid outlets 404 can be varied. For example, the fluid conduit 400 can include a plurality of spaced apart fluid outlets 404.

The vertical mover assembly 58 couples and secures the pad holder 50 to the rotator shaft 402. Additionally, the vertical mover assembly 58 is used to control the force of the pad 48 against the substrate 12 (illustrated in FIG. 3A) and the position of the pad 48 relative to the substrate 12. In one embodiment, the vertical mover assembly 58 includes a first pad mover 406 and a second pad mover 408. In one embodiment, the first pad mover 406 is used to make a relatively coarse adjustment to the position of the pad 48 relative to the substrate 12 and coarse force adjustment; and the second pad mover 408 is used to make a relatively fine adjustment to the position of the pad 48 relative to the substrate 12 and fine force adjustment. Alternatively, the first pad mover 406 can be designed to make a relatively fine adjustment to the position of the pad 48 relative to the substrate 12 and the second pad mover 408 can be designed to make a relatively coarse adjustment to the position of the pad 48 relative to the substrate 12.

In FIG. 4B, the first pad mover 406 includes a mover housing 410, a mover drive ring 412, and a mover fluid source 414. In this embodiment, the mover housing 410 is somewhat bell shaped and includes a disk shaped top section 416 and a generally annular shaped side wall 418 that extends downward from the top section 416. In this embodiment, the wall 418 includes a first section 420F having a first inner diameter and a second section 420S having a second inner diameter that is greater than the first inner diameter. In this embodiment, the top section 416 is fixedly secured to the rotator shaft 402.

The mover drive ring 412 is generally disk shaped and is secured to the bottom of the side wall 418 of the mover housing 410. A bottom of the mover drive ring 412 is secured to the top of the pad holder 50. In one embodiment, the mover drive ring 412 is made of a magnetic material such as iron, silicon steal or Ni—Fe Steel. In this embodiment, the mover drive ring 412 transfers rotational force from the rotator shaft 402 to the pad holder 50. The mover housing 410 and the mover drive ring 412 cooperate to define a mover chamber 422.

The mover fluid source 414 directs a fluid 424 (illustrated as triangles) into the mover chamber 422 to adjust the position of the mover drive ring 412, and pad holder 50 relative to the rotator shaft 402. As the pressure of the pressurized fluid inside the mover chamber 422 increases, the mover drive ring 412 will move downward so as to slightly increase the volume inside the mover chamber 422. Conversely, as the pressure of the pressurized fluid inside the mover chamber 422 decreases, the mover drive ring 412 will deform and move upward so as to slightly decrease the volume inside the mover chamber 422. As the mover drive ring 412 moves so as to slightly increase or decrease the volume inside the mover chamber 422, the mover drive ring 412 transfers the pressure from inside the mover chamber 422 toward the polishing pad 48 to influence the force that the polishing pad 48 applies against the substrate 12.

The type of fluid 424 utilized can be varied. In one embodiment, the fluid 424 is air. Alternatively, for example, the fluid 424 can be another type of gas.

As a result of this structure, the rotational movement of the rotator shaft 402 results in rotational movement of the mover housing 410, the mover drive ring 412, the pad holder 50, and the polishing pad 48.

The design of the second pad mover 408 can be varied. In FIG. 4B, the second pad mover 408 includes a first housing 426, a bearing assembly 428, a second housing 430, and an actuator assembly 432. The design of each of these components can be varied. In FIG. 4B, the first housing 426 includes a generally flat ring shaped first section 434 and an annular ring shaped second section 436 that extends downward from the first section 434.

The bearing assembly 428 secures the first section 434 of the first housing 426 to the rotator shaft 402 and allows the rotator shaft 402 to rotate relative to the first housing 426. In one embodiment, the bearing assembly 428 includes a rolling type bearing. Additionally, another structure or frame (not shown) can be used to secure the first housing.

The second housing 430 is generally annular tube shaped and includes a bottom end that is fixedly secured to the top of the pad holder 50. In this embodiment, the second housing 430 rotates concurrently with the pad holder 50, the rotator shaft 402 and the pad 48. Further, the second housing 430 rotates relative to the stationary first housing 426.

The actuator assembly 432 defines one or more actuators 438 that cooperate to move the second housing 430, the pad holder 50 and the pad 48 relative to the first housing 426, the rotator shaft 402, and the substrate 12. For example, in one embodiment, the actuator assembly 432 includes a plurality of attraction only type actuators 438. In FIG. 4B, the actuator assembly 432 includes a plurality of spaced apart first actuator subassemblies 440 (only one is illustrated in FIG. 4B) that are secured to the first housing 426 and a single second actuator subassembly 442 that is secured to the second housing 430 and rotates with the second housing 430. The second actuator subassembly 442 is spaced apart a component gap 444 away from each first actuator subassembly 440. In one embodiment, during normal operation of the actuator assembly 432, the component gap 444 is in the range of between approximately 0.5 mm and 2 mm.

It should be noted that at any given time, the component gap 444 for each of the actuators 438 is different. Further, during operation of the apparatus 10, the component gap 444 for each of the actuators 438 usually increases as the polishing pad 48 (illustrated in FIG. 3A) wears.

Figure 4C:
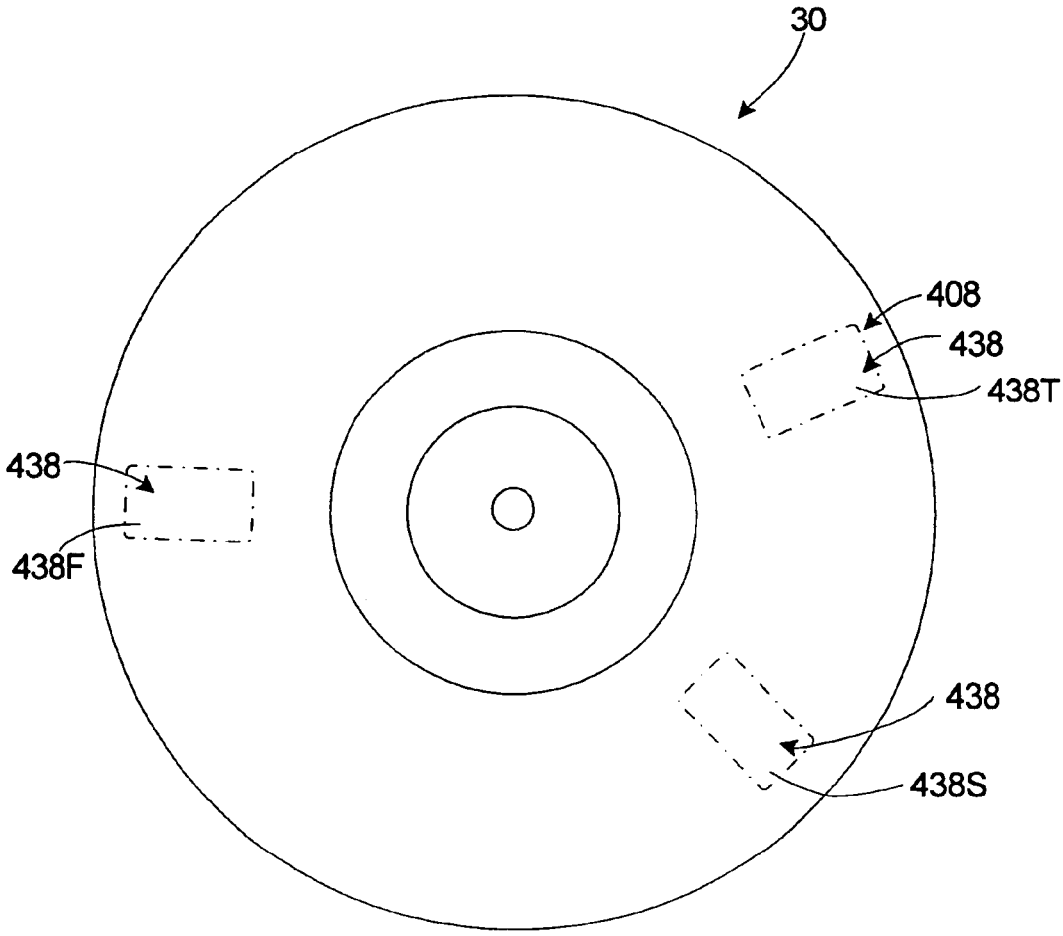
FIG. 4C is a top plan view of the polishing head assembly of FIG. 4A.

FIG. 4C illustrates a top view of a portion of the polishing system 30 of FIG. 4A. FIG. 4C illustrates that the second pad mover 408 includes three actuators 438 (illustrated in phantom), including a first actuator 438F, a second actuator 438S, and a third actuator 438T. In one embodiment, the actuators 438F, 438S, 438T are evenly not spaced apart. In this embodiment, the second and third actuators 438S, 438T are spaced closer together and the second and third actuators 438S, 438T are equal distances from the first actuator 438F.

Figure 5A:
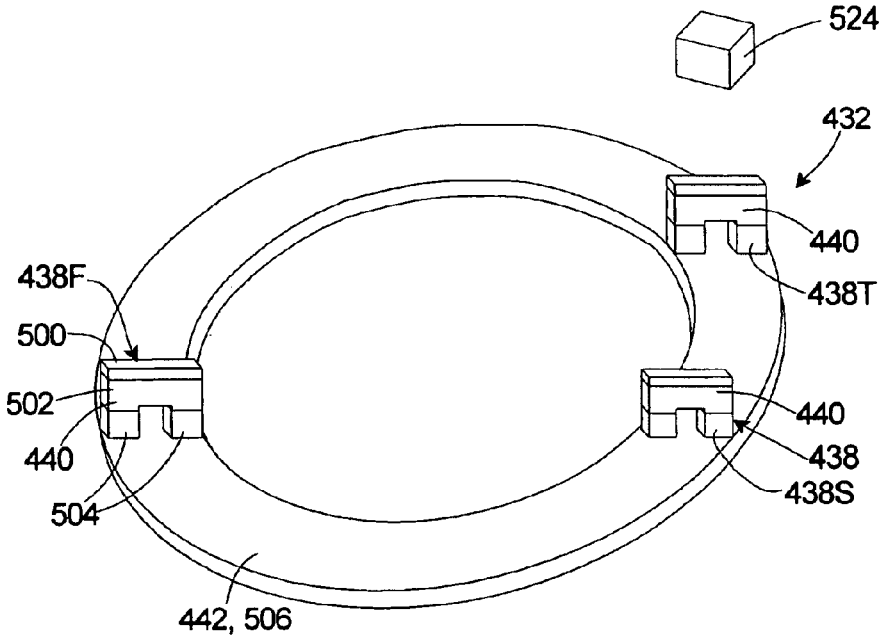
FIG. 5A is a perspective view of an actuator assembly having features of the present invention.

FIG. 5A illustrates a perspective view of one embodiment of the actuator assembly 432 including the control system, three spaced apart first actuator subassemblies 440 and one second actuator subassembly 442 that is spaced apart from the first actuator subassemblies 440 and form three spaced apart actuators 438F, 438S, 438T. Alternatively, for example, the actuator assembly 432 can include more than three or less than three first actuator subassemblies 440. Each of the first actuator subassemblies 440 are spaced apart component gap $g_1$, $g_2$, $g_3$ from the second actuator subassembly 442.

In this embodiment, each of the first actuator subassemblies 440 includes a sensor 500, a first core 502 and a pair of spaced apart conductors 504. Further, the second actuator subassembly 442 is generally flat annular ring shaped and defines a second core 506.

In this embodiment, the control system 524 directs current to the conductors 504 of each first actuator subassembly 440 to attract the second core 506 towards the first core 502.

The sensor 500 can be a load cell, e.g. a strain guage, or another type of sensor that measures the force that acts upon the sensor 500. Because the sensor 500 secures the first actuator subassembly 440 to the first housing 426 (illustrated in FIG. 4B), each sensor 500 measures the force generated by the attraction between the actuator subassemblies 440, 442.

Each first actuator subassembly 440 and the second actuator subassembly 442 cooperate to form an actuator 438. Each actuator 438, in this embodiment, is an electromagnetic, attraction only actuator. In one embodiment, the first core 502 is a C-shaped core ("C core") and the second core 506 is a ring-shaped. The second core 506 is substantially ring-shaped and rotates with the pad holder 50 (illustrated in FIG. 4B). As the ring-shaped second core 506 rotates, a portion of the second core 506 will be positioned substantially directly beneath each of the first cores 502 at any point in time. The portion of the ring-shaped second core 506 that interacts with the first core 502 at any point in time is substantially I-shaped. As the second core 506 continues to rotate, the particular portion of the second core 506 that is positioned substantially directly beneath each of the first cores 502 will change, but at any point in time there will always be some portion of the second core 506 that will be positioned so as to interact with each of the first cores 502.

The first cores 502 and the second core 506 are each made of a magnetic material such as iron, silicon steel or Ni—Fe steel. The conductors 504 are made of an electrically conductive material.

For the first actuator 438F, a first current $I_1$ (not shown) directed through the conductor(s) 504 generates an electromagnetic field that attracts the second core 506 towards the first core 502. This results in an attractive first force $F_1$ across the first component gap $g_1$. Similarly, for the second actuator 438S, a second current $I_2$ directed through the conductor(s) 504 generates an electromagnetic field that attracts the second core 506 towards the first core 502. This results in an attractive second force $F_2$ across the second gap 92. Furthermore, for the third actuator 438T, a third current $I_3$ directed through the conductor(s) 504 generates an electromagnetic field that attracts the second core 506 towards the first core 502. This results in an attractive third force $F_3$ across the gap $g_3$. The amount of current determines the amount of attraction. With this design, the first actuator 438F urges the pad 48 with a controlled first force $F_1$, the second actuator 438S urges the pad 48 with a controlled second force $F_2$, and the third actuator 438T urges the pad 48 with a controlled third force $F_3$.

Figure 5B:
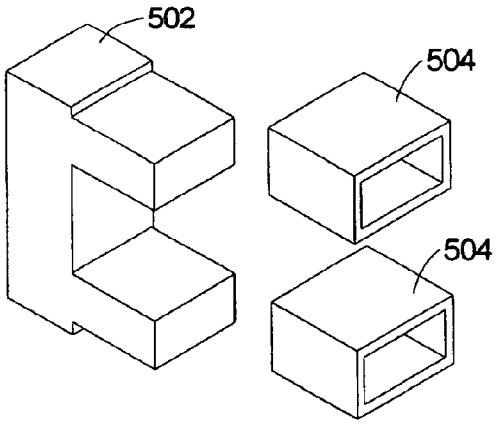
FIG. 5B is a side illustration of a portion of the actuator assembly of FIG. 5A.

FIG. 5B is an exploded perspective view of one embodiment of the first core 502 and conductors 504. In this embodiment, the first core 502 is somewhat "C" shaped. One tubular shaped conductor 504 is positioned around each end bar of the C shaped core 502. The combination of the C shaped first core 502 and the conductors 504 is sometimes referred to herein as an electromagnet.

Figure 5C:
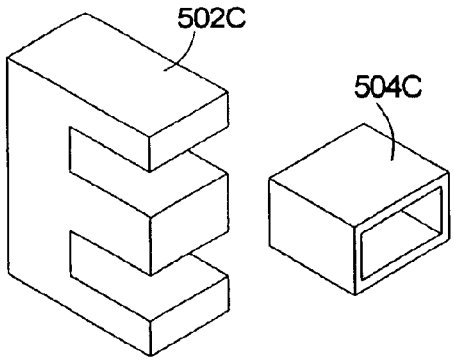
FIG. 5C is a side illustration of another embodiment of a portion of an actuator assembly that can be used in the polishing head assembly of FIG. 4A.

FIG. 5C is a perspective view of another embodiment of the first core 502C and the conductor 504C. In this embodiment, the first core 502C is E-shaped. The conductor 504 is positioned around the center bar of the E shaped first core 502C.

The electromagnet actuators 438 illustrated in FIGS. 5A–5C are variable reluctance actuators and the reluctance varies with the size of the component gap 444 (illustrated in FIG. 4B), which, of course also varies the flux and the force applied to the second core 502. The electromagnet actuators 438 can provide large force with relatively small current and their physical dimensions are much smaller than conventional actuators.

The control system 524 (i) determines the amount of current that should be directed to the conductors 504 of the first actuator subassemblies 440 and the amount of pressure in mover chamber 422, (ii) controls the mover fluid source 414 to direct fluid 424 into the mover chamber 422, and (iii) directs current to the conductors 504 of the first actuator subassemblies 440 to achieve the desired force between the pad 48 (illustrated in FIG. 3A) and the substrate 12 (illustrated in FIG. 3A). Stated another way, the control system 24 controls the fluid 424 to the mover chamber 422 and current level for each conductor 504 to achieve the desired resultant forces and position the pad 48 relative to the substrate 12.

In one embodiment, the control system 524 independently directs current to each of the conductors 504 of the second pad mover 408 at a plurality of discrete time steps t, namely $t_1$, $t_2$, $t_3$, $t_4$ . . . $t_x$. At each time step, the sensor 500 also measures the force that is generated by each of the actuators 438F, 438S, 438T. The time interval that separates each time step t can be varied. In alternative examples, the time interval between time steps t is approximately 0.5, 1, 1.5, 2, 2.5 or 3 milliseconds. However, the time interval can be larger or smaller than these values. The term time interval is also referred to herein as sampling rate.

Figure 6:
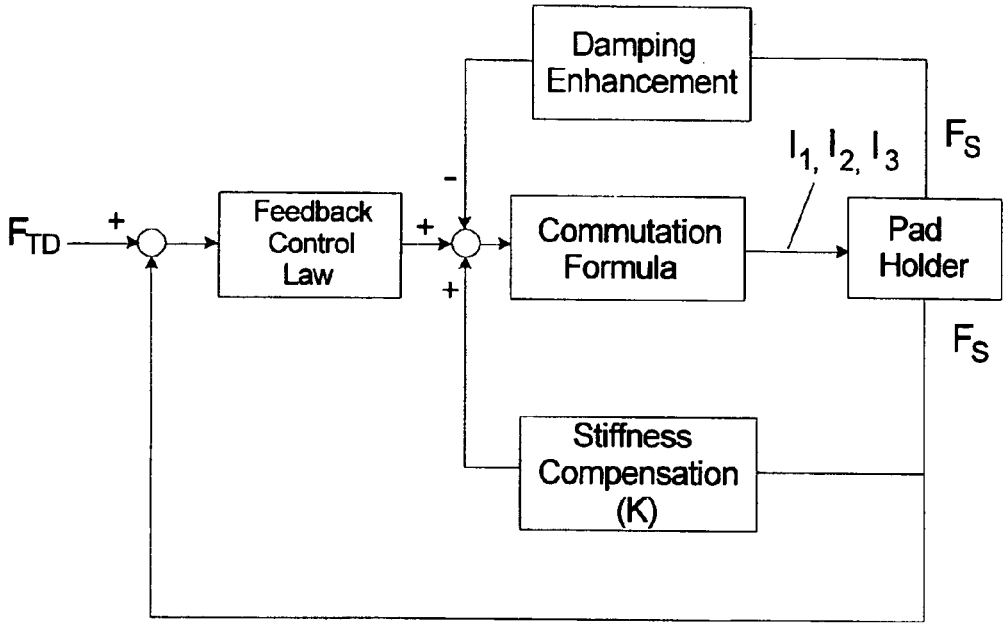
FIG. 6 is a graph that illustrates the functions of the control system.

FIG. 6 is a schematic that illustrates the functions of the control system 524. Initially, at each time step t, the control system determines a total desired force $F_{TD}$ of the pad against the substrate based on the desired polishing of the substrate. A first mover force $F_{M1}$ applied by the first pad mover is subtracted from the total desired force $F_{TD}$ to determine (i) the amount the first force $F_1$ to be applied by the first actuator 438F, (ii) the amount the second force $F_2$ to be applied by the second actuator 438S, and (iii) the amount the third force $F_3$ to be applied by the third actuator 438T. The control law s304 prescribes the corrective action for the signal. The feedback control law may be in the form of a PI (proportional integral) controller, proportional gain controller or a lead-lag filter, or other commonly known law in the art of control, for example.

Each actuator 438F, 438S, 438T requires some kind of commutation to globally compensate for the non linearity between the input current and component gap to the force output. The control system uses a commutation formula to determine the amount of current that is to be individually directed to each of the conductors 504 of the second pad mover to achieve the forces $F_1$, $F_2$, $F_3$ at each actuator 438F, 438S, 438T at each time step t. Stated another way, the control system calculates a first current $I_1$ needed at the first actuator 438F to achieve the desired $F_1$ at the first actuator 438F, a second current $I_2$ needed at the second actuator 428S to achieve the desired $F_2$ at the second actuator 438S, and a third current $I_3$ needed at the third actuator 428T to achieve the desired $F_3$ at the third actuator 438T. The currents $I_1$ $I_2$ $I_3$ are directed to the actuators 438F, 438S, 438T and the actuators 438F, 438S, 438T impart forces $F_1$, $F_2$, $F_3$ on the pad at each time step t.

In one embodiment, the control system 524 independently directs current $I_1$ $I_2$ $I_3$ to each of the conductors 504 of the second pad mover 408 at each time step t so that the forces $F_1$, $F_2$, $F_3$ generated by each of the actuators 438F, 438S, 438T is approximately the same. In alternative embodiments, the control system 24 directs current to the conductors 504 so that the forces $F_1$, $F_2$, $F_3$ generated by each of the actuators 438F, 438S, 438T is within at least approximately 0.1, 0.2, 0.5, 1, 2, 5, 10, 20, or 100 Newtons. Stated another way, in alternative embodiments, the control system 24 directs current to the conductors 504 so that the forces $F_1$, $F_2$, $F_3$ generated by each of the actuators 438F, 438S, 438T are within at least approximately 1, 2, 5, 10, 20, 40, or 50 percent. Alternatively, the control system 24 can direct current to the conductors 504 so that the force of the pad 48 against the substrate 12 is substantially uniform across the pad 48 that is against the substrate 12. In alternative embodiments, for example, the control system 24 can direct current to the conductors 504 so that difference in force of the pad 48 against the substrate 12 at any and every two spaced apart locations is within at least approximately 0.05, 0.075, 0.1, 0.15, 0.2, 0.5 or 1 newtons. Stated another way, in alternative embodiments, the control system 24 can direct current to the conductors 504 so that difference in force of the pad 48 against the substrate 12 at any and every two spaced apart locations is within at least approximately 0.5, 1, 2, 5, 10 or 20 percent.

As provided herein, the actual output force $F_1$, $F_2$, $F_3$ generated by one of the actuators 438F, 438S, 438T can be expressed as follows:

$$F=k(I^2)/(g^2) \qquad \text{equation 1}$$

where F is in Newtons; k is an electromagnetic constant which is dependent upon the geometries of the first core and the second core, and the number of coil turns in the conductor(s); I is current, measured in amperes that is directed to the conductor(s); and g is the gap distance, measured in meters.

The actual value of k is not exactly known because they depend upon the geometries, shape and alignment of the first core and the second core. In one embodiment, $k=\frac{1}{2}N^2\mu_o wd$; where N=the number of coil turns in the conductor(s); $\mu_o$=a physical constant of about $1.26\times10^{-6}$ H/m; w=the half width of the center of the first core, in meters; and d=the depth of the center of the first core, in meters. In one embodiment, k is equal to $7.73\times10^{-6}$ kg $m^3/s^2A^2$;

Equation 1 can be rewritten as follows:

$$I=g\times\sqrt{(F/k)} \qquad \text{equation 2}$$

$$g=I\times\sqrt{(k/F)} \qquad \text{equation 3}$$

However, in some embodiments, it is very difficult to accurately measure the component gap $g_1$ $g_2$ $g_3$ at each of the actuators 438F, 438S, 438T.

In one embodiment, when the measured value of the component gap is not available and when the component gap $g_1$ $g_2$ $g_3$ does not deviate from an operational value g', then a simplified commutation may be used. In one embodiment, the operational value g' is within with a range of between approximately 0.5 mm and 1.5 mm. However, the range may be larger or smaller.

In this example, because g' and k are constant, they can be merged to the control gain and then equation 2 can be simplified as follows:

$$I=\sqrt{F} \qquad \text{equation 4}$$

In this embodiment, at each time step t, the control system (i) takes the square root of the $F_1$ to determine the current $I_1$ that should be directed to the first actuator 438F, (ii) takes the square root of the $F_2$ to determine the current $I_2$ that should be directed to the second actuator 438S, and (iii) takes the square root of the $F_3$ to determine the current $I_3$ that should be directed to the third actuator 438T.

In an alternative embodiment, for a system without component gap measurement but with large deviation of the component gap $g_1$ $g_2$ $g_3$, a calculated component gap $g_1$ $g_2$ $g_3$ can be calculated by the control system using information from one or more previous samples. For example, equation 3 from above can be rewritten as following:

$$g(t-1)=I(t-1)\times\sqrt{(k/F(t-1))} \qquad \text{equation 5}$$

In this embodiment, F is the actual force $F_1$, $F_2$, $F_3$ applied by the particular actuator 438F, 438S, 438T at a previous time step t. The actual force $F_1$, $F_2$, $F_3$ applied by the particular actuator 438F, 438S, 438T can be measured by the sensor 500 of each actuator 438F, 438S, 438T.

Figure 7:
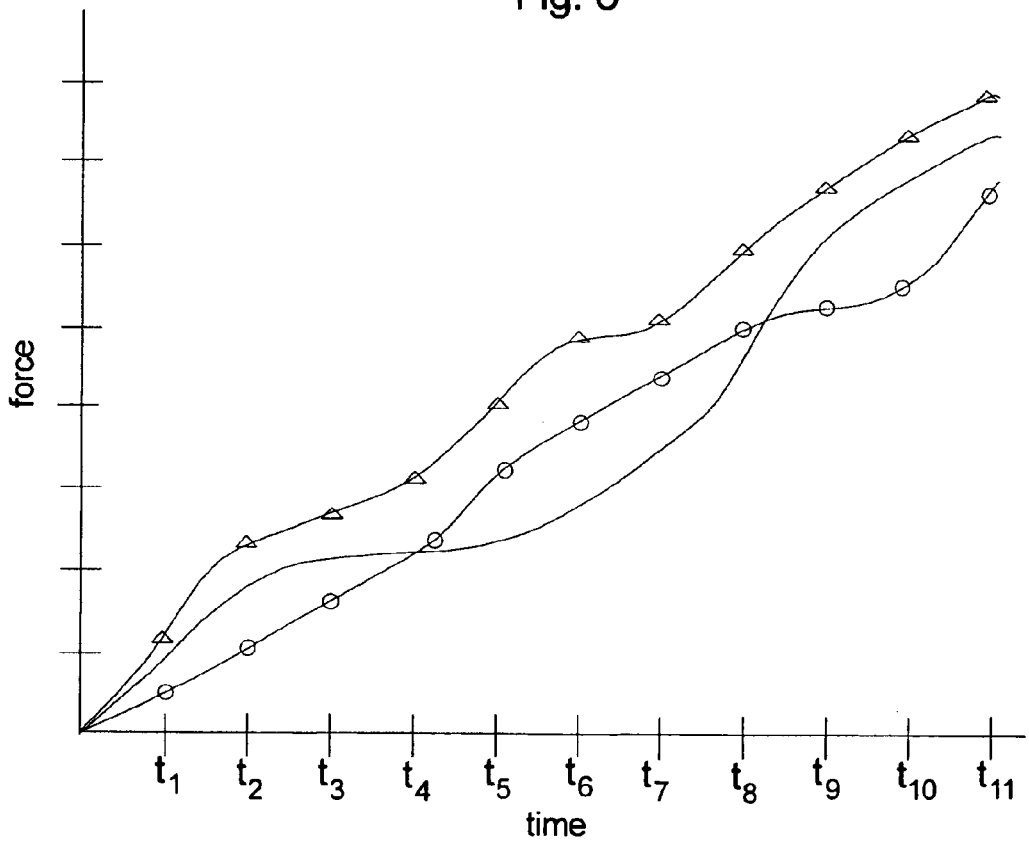
FIG. 7 is a graph that illustrates the measured forces at a plurality of time steps.

FIG. 7 is a graph that illustrates the measured forces $F_1$ (solid line), $F_2$ (solid line with triangles), and $F_3$ (solid line with circles) at a plurality of time steps t. This graph is useful to understand the subsequent versions of the invention described below.

In one embodiment, if the control-sampling rate (length of time interval) is much faster than the rate at which the component gap $g_1$ $g_2$ $g_3$ changes, then the component gap $g_1$ $g_2$ $g_3$ can be estimated by using only one earlier sample data.

$$g''(t)=g(t-1)=I(t-1)\times\sqrt{(k/F(t-1))} \qquad \text{equation 6}$$

Referring to FIG. 7, in this embodiment, (i) the value of $F_1$ at the immediately previous time step t-1 is used to calculate the gap $g_1$ and subsequently the current $I_1$ that should be directed to the first actuator 438F at a particular time step t, (ii) the value of $F_2$ at the immediately previous time step t-1 is used to calculate the gap $g_2$ and subsequently the current $I_2$ that should be directed to the second actuator 438S at a particular time step t, (iii) the value of $F_3$ at the immediately previous time step t-1 is used to calculate the gap $g_3$ and subsequently the current $I_3$ that should be directed to the third actuator 438T at the next time step t.

As an example, in this embodiment, at time step $t_5$, (i) the sensor 500 measures the $F_1$ applied by the first actuator 438F, (ii) the sensor 500 measures the $F_2$ applied by the second actuator 438S, and (iii) the sensor 500 measures the $F_3$ applied by the third actuator 438T. Subsequently, during the time interval between time step $t_5$ and $t_6$, the control system (i) uses the value of $F_1$ to determine the approximate gap $g_1$ and the current $I_1$ that should be directed to the first actuator 438F at time step $t_6$, (ii) uses the value of $F_2$ to determine to determine the approximate gap $g_2$ and the current $I_2$ that should be directed to the second actuator 438S at time step $t_6$, and (iii) uses the value of $F_3$ to determine the approximate gap $g_2$ and the current $I_3$ that should be directed to the third actuator 438T at time step $t_6$. This same process can be used in subsequent time steps t to determine the appropriate for currents $I_1$ $I_2$ $I_3$.

However, in an alternative embodiment, if the control-sampling rate (length of time interval) is much slower than the rate at which the component gap $g_1$ $g_2$ $g_3$ changes, then the component gap $g_1$ $g_2$ $g_3$ can be estimated by using data from at least two earlier samples.

$$\hat{g}(t) = \sum_{j=1}^{N} \alpha j(t) g(t-j) \qquad \text{equation 7}$$

The parameters $\alpha j(t)$ can be fixed numbers or updated online as follows:

$$\alpha j(t+1) = \alpha j(t) + \Delta\alpha j(t) \qquad \text{equation 8}$$

$$\Delta\alpha j(t) = \alpha g(t-j)(g(t) - \hat{g}(t)) \qquad \text{equation 9}$$

The number of earlier samples utilized will vary according to the rate at which the component gap $g_1$ $g_2$ $g_3$ changes. Generally speaking, more control samples are used if the component gap $g_1$ $g_2$ $g_3$ rapidly changes than when the component gap $g_1$ $g_2$ $g_3$ does not change as rapidly. In alternative examples, the control system can utilize 2, 3, 4, 5, 6, 8, or 10 previous control samples.

For example, in one embodiment, the control system utilizes 4 previous control steps. Referring to FIG. 7, in this embodiment, (i) the value of $F_1$ at the immediately previous four time steps t-1 through t-4 are used to estimate the $g_1$ and subsequently calculate the current $I_1$ that should be directed to the first actuator 438F at a particular time step t, (ii) the value of $F_2$ at the immediately previous four time steps t-1 through t-4 are used to estimate $g_2$ and subsequently calculate the current $I_2$ that should be directed to the second actuator 438S at a particular time step t, (i) the value of $F_3$ at the immediately previous four time steps t-1 through t-4 are used to estimate $g_3$ and subsequently calculate the current $I_3$ that should be directed to the third actuator 438T at the next time step t.

As an example, in this embodiment, at time step $t_8$, (i) the sensor 500 measures the $F_1$ applied by the first actuator 438F at $t_4$–$t_7$, (ii) the sensor 500 measures the $F_2$ applied by the second actuator 438S at $t_4$–$t_7$, and (iii) the sensor 500 measures the $F_3$ applied by the third actuator 438T at $t_4$–$t_7$. Subsequently, during the time interval between time step $t_7$ and $t_8$, the control system (i) uses the values of $F_1$ at $t_4$–$t_7$ to determine the current $I_1$ that should be directed to the first actuator 438F at time step $t_8$, (ii) uses the values of $F_1$ to determine the current $I_2$ that should be directed to the second actuator 438S at time step $t_8$, and (iii) uses the values of $F_3$ at $t_4$–$t_7$ to determine the current 13 that should be directed to the third actuator 438T at time step $t_8$. This same process can be used in subsequent time steps t to determine the appropriate for currents $I_1$ $I_2$ $I_3$.

It should be noted that in this embodiment, the slope of measured forces $F_1$ (solid line), $F_2$ (solid line with triangles), and $F_3$ (solid line with circles) can be taken into consideration when calculating the respective gap $g_1$ $g_2$ $g_3$.

In one embodiment, as illustrated in FIG. 6, the control system can include a stiffness compensator (K) that provides stiffness compensation for the system. More specifically, as provided herein, the mechanical structure, e.g. the first housing 426 and the second housing 430, of the polishing system 30 and the pad 48 usually have finite stiffness. This stiffness contributes to resonance of the polishing system 30. When the resonance frequency is within the desired bandwidth of the actuators 438, the system 30 may have an oscillation problem, leading to lower bandwidth and poorer performance of the polishing system. In this embodiment, the control system adjusts the current to the actuators to create a force that compensates for the stiffness of the system.

Additionally, as illustrated in FIG. 6, the control system can include a damping enhancement (C) that damps out oscillations of the system. The damping enhancement can be used to estimate an artificial force that should be applied by the actuators to dampen oscillations. Stated another way, with this design, the control system adjusts the current to the actuators to create a force that dampens oscillations of the system.

Damping other than the hardware setup may be provided by feedback control of the damping enhancement. In one embodiment, in order to do that, derivative of force output, (i.e. jerk) can be estimated using a filter.

Simple difference $$D(z^{-1}) = 1/T(1 - z^{-1})$$

$3^{rd}$ order filer $$D(z^{-1}) = 1/T(0.3 + 0.1z^{-1} - 0.1z^{-2} - 0.3z^{-3})$$

and $7^{th}$ order filter $$D(z^{-1}) = 1/T(0.0833 + 0.595z^{-1} + 0.119z^{-3} - 0.0119z^{-4} - 0.0357z^{-5} - 0.0595z^{-6} - 0.0833z^{-7})$$

Higher order estimation has smoother output with the tradeoff of longer time delays.

Figure 8:
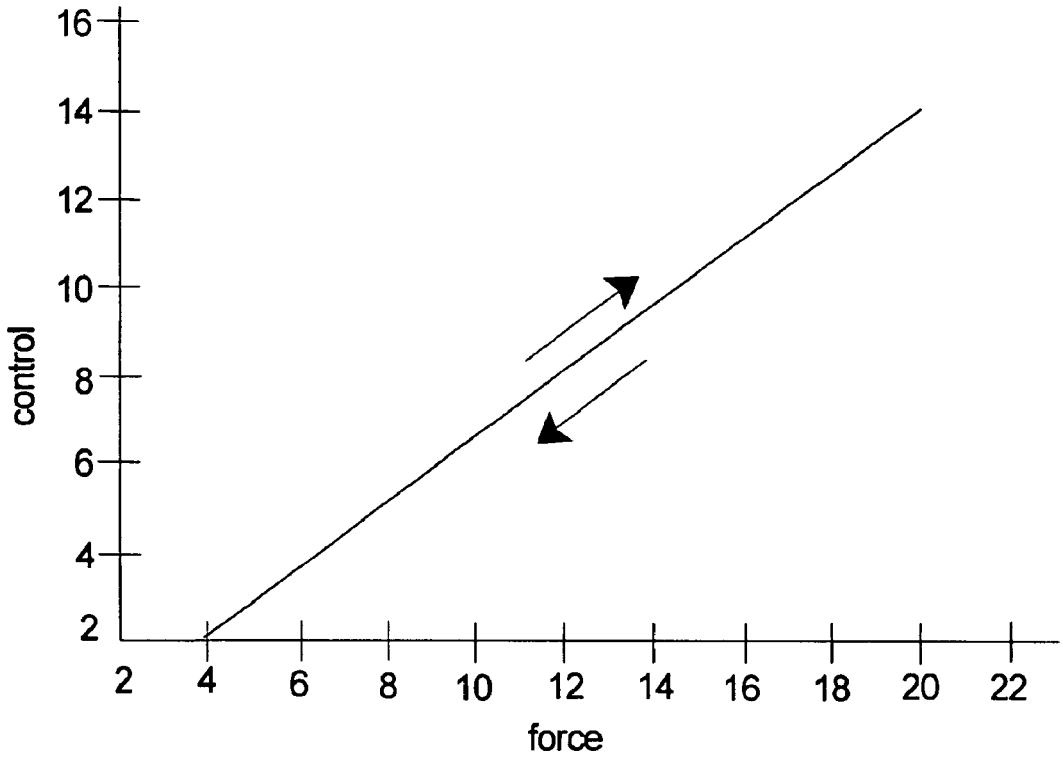
FIG. 8 is a graph that illustrates force versus voltage.

FIG. 8 is a graph that illustrates the relationship between voltage and force for one embodiment of an actuator. In this embodiment, as voltage is increased, force generated by the actuator is also increased.

Figure 9A:
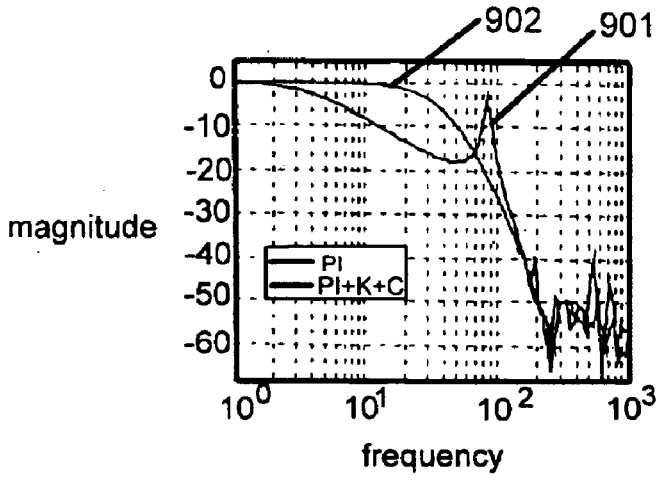
FIGS. 9A–9F are alternative graphs that illustrate features of the present invention.
Figure 9C:
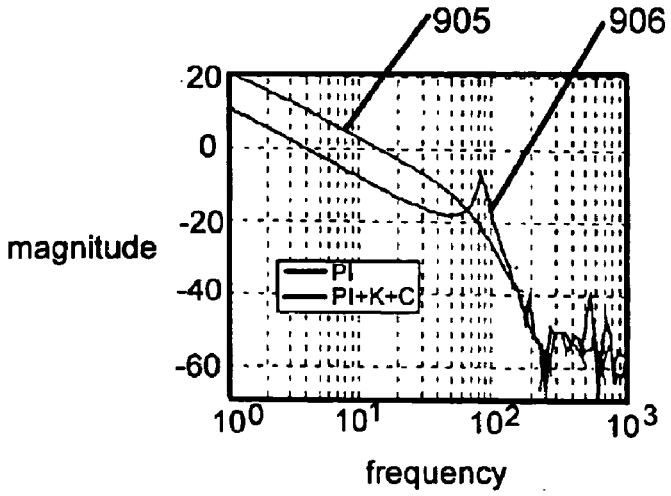
Figure 9E:
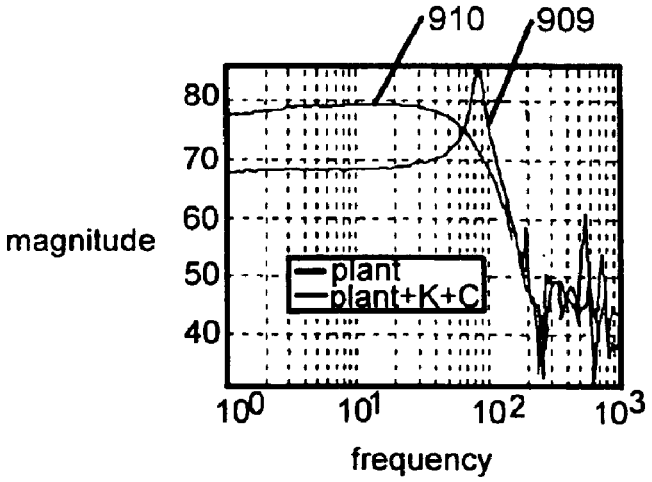
Figure 9B:
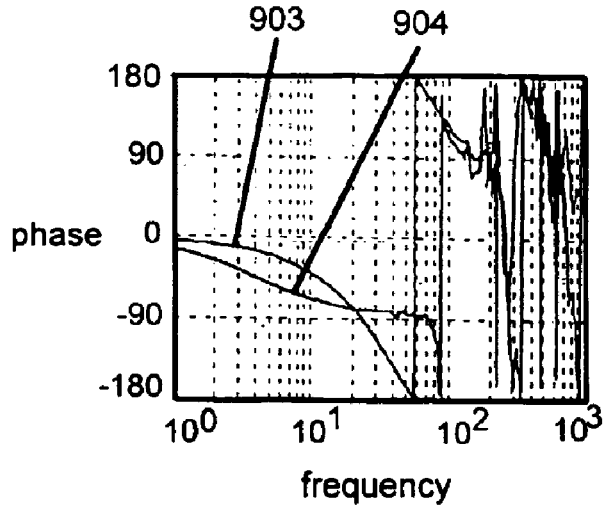

FIGS. 9A and 9B are alternative graphs that illustrate the closed loop frequency response of a system. In FIG. 9A, the graph represents magnitude versus frequency for a system. Line 901 represents the response of the system if the control system does not utilize damping enhancement and stiffness compensation and line 902 represents the response of the system if the control system utilizes damping enhancement and stiffness compensation. In FIG. 9B, the graph represents phase versus frequency for a system. Line 903 represents the response of the system if the control system does not utilize damping enhancement and stiffness compensation and line 904 represents the response of the system if the control system utilizes damping enhancement and stiffness compensation.

Figure 9D:
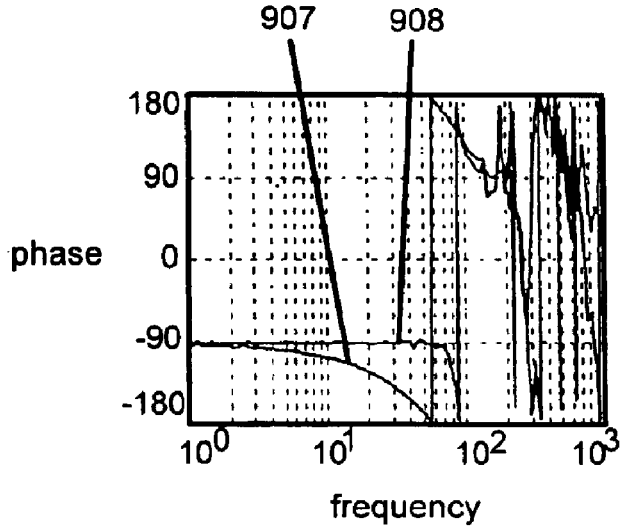

FIGS. 9C and 9D are alternative graphs that illustrate the open loop frequency response of a system. In FIG. 9C, the graph represents magnitude versus frequency for a system. Line 905 represents the response of the system if the control system does not utilize damping enhancement and stiffness compensation and line 906 represents the response of the system if the control system utilizes damping enhancement and stiffness compensation. In FIG. 9D, the graph represents phase versus frequency for a system. Line 907 represents the response of the system if the control system does not utilize damping enhancement and stiffness compensation and line 908 represents the response of the system if the control system utilizes damping enhancement and stiffness compensation.

Figure 9F:
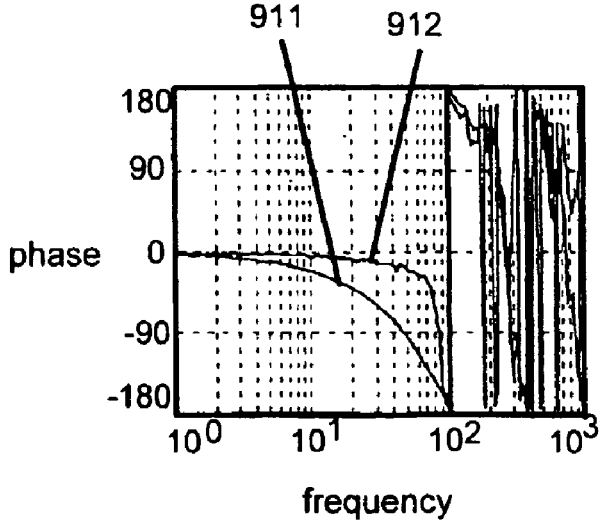

FIGS. 9E and 9F are alternative graphs that illustrate the plant frequency response of a system. In FIG. 9E, the graph represents magnitude versus frequency for a system. Line 909 represents the response of the system if the control system does not utilize damping enhancement and stiffness compensation and line 910 represents the response of the system if the control system utilizes damping enhancement and stiffness compensation. In FIG. 9F, the graph represents phase versus frequency for a system. Line 911 represents the response of the system if the control system does not utilize damping enhancement and stiffness compensation and line 912 represents the response of the system if the control system utilizes damping enhancement and stiffness compensation.

Figure 10A:
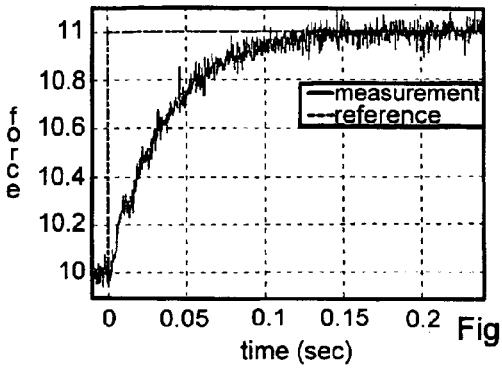
FIGS. 10A–10E are alternative graphs that illustrate features of the present invention.

FIG. 10A is a graph that illustrates the force step response from 10 newtons to 11 newtons for a system if the control system does not utilize damping enhancement and stiffness compensation.

Figure 10B:
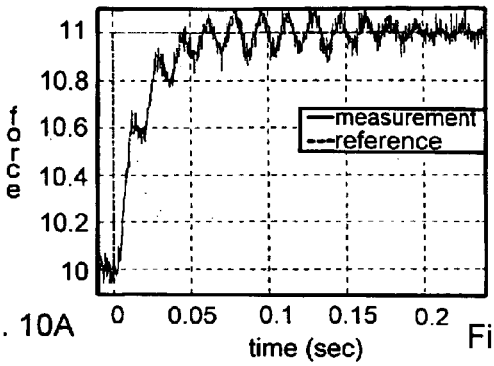

FIG. 10B is a graph that illustrates the force step response from 10 newtons to 11 newtons for a system if the control system that utilizes stiffness compensation.

Figure 10C:
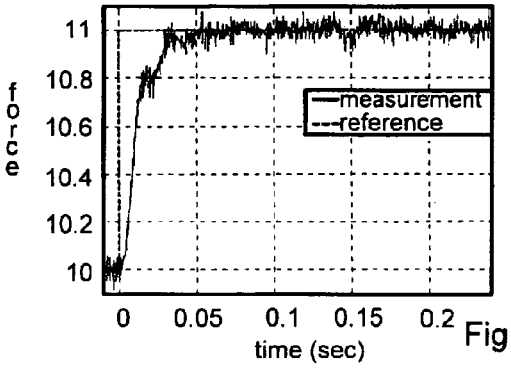

FIG. 10C is a graph that illustrates the force step response from 10 newtons to 11 newtons for a system if the control system that utilizes first order damping enhancement and stiffness compensation.

Figure 10D:
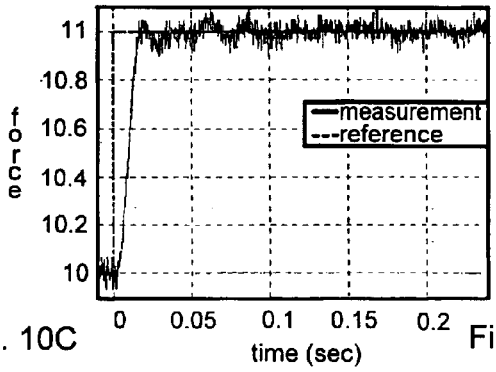

FIG. 10D is a graph that illustrates the force step response from 10 newtons to 11 newtons for a system if the control system that utilizes third order damping enhancement and stiffness compensation.

Figure 10E:
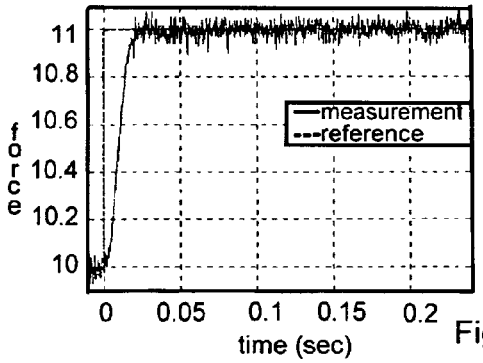

FIG. 10E is a graph that illustrates the force step response from 10 newtons to 11 newtons for a system if the control system that utilizes seventh order damping enhancement and stiffness compensation.

The graphs provided herein illustrate that with stiffness compensation and additional software damping, the system dynamics can be well re-shaped. Hence the resonance due to the mounting can be completely removed.

While the particular apparatus 10 and method as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. An actuator assembly comprising:

a first attraction only actuator including a first core, a conductor secured to the first core, and a second core spaced apart a component gap from the first core; and a control system that directs current to the conductor to attract the second core to the first core, wherein the amount of current directed to the conductor is calculated without measuring the component gap, wherein the control system utilized the formula $I=\sqrt{F}$ to calculate the amount of current directed to the conductor, wherein I is the current and F is the force to be generated by the first actuator.

2. The actuator assembly of claim 1 wherein the control system adjusts the current to the conductor to create an artificial force that dampens oscillations.

3. The actuator assembly of claim 1 wherein the control system adjusts the current to the conductor to create an artificial force that provides stiffness compensation.

4. The actuator assembly of claim 1 further comprising a second attraction only actuator including a first core, and a conductor secured to the first core.

5. An apparatus including the actuator assembly of claim 1.

6. An actuator assembly comprising:

a first attraction only actuator including a first core, a conductor secured to the first core, and a second core spaced apart a component gap from the first core; and a control system that directs current to the conductor at a plurality of time steps, including $t_1$, $t_2$, $t_3$, and $t_4$ to attract the second core to the first core, wherein the amount of current directed to the conductor is calculated without measuring the component gap.

7. An actuator assembly comprising:

a first attraction only actuator including a first core, a conductor secured to the first core, and a second core spaced apart a component gap from the first core; and a control system that directs current to the conductor to attract the second core to the first core, wherein the amount of current directed to the conductor is calculated without measuring the component gap, wherein the control system calculates a calculated gap between the cores at least one of $t_1$, $t_2$, and $t_3$, and wherein the control system uses the calculated gap to calculate the current that should be directed to the conductor at $t_4$.

8. The actuator assembly of claim 7 wherein the control system adjusts the current to the conductor to create an artificial force that dampens oscillations.

9. The actuator assembly of claim 7 wherein the control system adjusts the current to the conductor to create an artificial force that provides stiffness compensation.

10. The actuator assembly of claim 7 further comprising a second attraction only actuator including a first core, and a conductor secured to the first core.

11. An apparatus including the actuator assembly of claim 7.

12. An actuator assembly comprising:

a first attraction only actuator including a first core, a conductor secured to the first core, and a second core spaced apart a component gap from the first core; and a control system that directs current to the conductor to attract the second core to the first core, wherein the amount of current directed to the conductor is calculated without measuring the component gap, wherein the control system calculates a calculated gap between the cores at least two of $t_1$, $t_2$, and $t_3$, and wherein the control system uses the calculated gaps to calculate the current that should be directed to the conductor at $t_4$.

13. An actuator assembly comprising:

a first attraction only actuator including a first core that is substantially "C" shaped, a conductor secured to the first core, and a second core spaced apart a component gap from the first core; and a control system that directs current to the conductor to attract the second core to the first core, wherein the amount of current directed to the conductor is calculated without measuring the component gap.

14. An actuator assembly comprising:

a first attraction only actuator including a first core that is substantially "E" shaped, a conductor secured to the first core, and a second core spaced apart a component gap from the first core; and a control system that directs current to the conductor to attract the second core to the first core, wherein the amount of current directed to the conductor is calculated without measuring the component gap.

15. An actuator assembly comprising:

a first attraction only actuator including a first core, a conductor secured to the first core, and a second core spaced apart a component gap from the first core, wherein the first actuator is an electromagnetic actuator; and a control system that directs current to the conductor to attract the second core to the first core, wherein the amount of current directed to the conductor is calculated without measuring the component gap.

16. A polishing apparatus comprising:

a polishing pad; and an actuator assembly that is utilized to adjust the position of the pad, the actuator assembly including (i) a first attraction only actuator including a first core, a conductor secured to the first core, and a second core spaced apart a component gap from the first core; and (ii) a control system that directs current to the conductor to attract the second core to the first core, wherein the amount of current directed to the conductor is calculated without measuring the component gap.

17. A method for making a device that includes the steps of providing a substrate and polishing the substrate with the apparatus according to claim 16.

18. A method for making a wafer that includes the steps of providing a substrate and polishing the substrate with the apparatus according to claim 16.

19. A method for positioning a stage, the method comprising the steps of:

coupling a first attraction only actuator to the stage, the first actuator including a first core, a conductor secured to the first core, and a second core spaced apart a component gap from the first core; and directing current with a control system to the conductor to attract the second core to the first core, wherein the amount of current directed to the conductor is calculated without measuring the component gap, wherein the control system uses the formula $I=\sqrt{F}$ to calculate the amount of current directed to the conductor, wherein I is the current and F is the force to be generated by the actuator combination.

20. The method of claim 19 wherein the control system adjusts the current to the conductor to create an artificial force that dampens oscillations.

21. The method of claim 19 wherein the control system adjusts the current to the conductor to create an artificial force that provides stiffness compensation.

22. A method for positioning a stage, the method comprising the steps of:

coupling a first attraction only actuator to the stage, the first actuator including a first core, a conductor secured to the first core, and a second core spaced apart a component gap from the first core; and directing current with a control system to the conductor at a plurality of time steps, including $t_1$, $t_2$, $t_3$, and $t_4$, to attract the second core to the first core, wherein the amount of current directed to the conductor is calculated without measuring the component gap.

23. A method for positioning a stage, the method comprising the steps of:

coupling a first attraction only actuator to the stage, the first actuator including a first core, a conductor secured to the first core, and a second core spaced apart a component gap from the first core; and directing current with a control system to the conductor to attract the second core to the first core, wherein the amount of current directed to the conductor is calculated without measuring the component gap, wherein the control system calculates a calculated gap between the cores at least one of $t_1$, $t_2$, and $t_3$, and wherein the control system uses the calculated gap to calculate the current that should be directed to the conductor at $t_4$.

24. The method of claim 23 wherein the control system adjusts the current to the conductor to create an artificial force that dampens oscillations.

25. The method of claim 23 wherein the control system adjusts the current to the conductor to create an artificial force that provides stiffness compensation.

26. A method for positioning a stage, the method comprising the steps of:

coupling a first attraction only actuator to the stage, the first actuator including a first core, a conductor secured to the first core, and a second core spaced apart a component gap from the first core; and directing current with a control system to the conductor to attract the second core to the first core, wherein the amount of current directed to the conductor is calculated without measuring the component gap, wherein the control system calculates a calculated gap between the cores at least two of $t_1$, $t_2$, and $t_3$, and wherein the control system uses the calculated gaps to calculate the current that should be directed to the conductor at $t_4$.

27. A method for positioning a stage, the method comprising the steps of:

coupling a first attraction only actuator to the stage, the first actuator including a first core that is substantially "C" shaped, a conductor secured to the first core, and a second core spaced apart a component gap from the first core; and directing current with a control system to the conductor to attract the second core to the first core, wherein the amount of current directed to the conductor is calculated without measuring the component gap.

28. A method for positioning a stage, the method comprising the steps of:

coupling a first attraction only actuator to the stage, the first actuator including a first core that is substantially "E" shaped, a conductor secured to the first core, and a second core spaced apart a component gap from the first core; and directing current with a control system to the conductor to attract the second core to the first core, wherein the amount of current directed to the conductor is calculated without measuring the component gap.

29. A method for making an apparatus for polishing a wafer, the method comprising the steps of:

providing a pad;

securing the pad to a stage; and moving the stage by (i) coupling a first attraction only actuator to the stage, the first actuator including a first core, a conductor secured to the first core, and a second core spaced apart a component gap from the first core; and (ii) directing current with a control system to the conductor to attract the second core to the first core, wherein the amount of current directed to the conductor is calculated without measuring the component gap.

30. A method for making an object including at least a polishing process, wherein the polishing process utilizes the apparatus made by the method of claim 29.

31. A method of making a wafer including the steps of providing a substrate and polishing the substrate utilizing the apparatus made by the method of claim 29.

* * * * *